US011225822B2

(12) United States Patent
Partsch et al.

(10) Patent No.: US 11,225,822 B2
(45) Date of Patent: Jan. 18, 2022

(54) SYSTEM AND METHOD FOR OPENING AND CLOSING VEHICLE DOOR

(71) Applicant: Faraday&Future Inc., Gardena, CA (US)

(72) Inventors: Matthew Richard Partsch, San Pedro, CA (US); Jenna Marie Kadlec, Pomona, CA (US); Daniel L. Kowalewski, Redondo Beach, CA (US); Cian John Francis Brogan, Los Angeles, CA (US); Matt John Sampson, Redondo Beach, CA (US)

(73) Assignee: Faraday&Future Inc., Gardena, CA (US)

( * ) Notice: Subject to any disclaimer, the term of this patent is extended or adjusted under 35 U.S.C. 154(b) by 0 days.

(21) Appl. No.: 15/757,651

(22) PCT Filed: Sep. 1, 2016

(86) PCT No.: PCT/US2016/049858
§ 371 (c)(1),
(2) Date: Mar. 5, 2018

(87) PCT Pub. No.: WO2017/040758
PCT Pub. Date: Mar. 9, 2017

(65) Prior Publication Data

US 2019/0024435 A1 Jan. 24, 2019

Related U.S. Application Data

(60) Provisional application No. 62/235,371, filed on Sep. 30, 2015, provisional application No. 62/232,418,
(Continued)

(51) Int. Cl.
*E06B 3/00* (2006.01)
*E05F 15/73* (2015.01)
(Continued)

(52) U.S. Cl.
CPC ..... *E05F 15/73* (2015.01); *E05F 15/40* (2015.01); *E05F 15/43* (2015.01); *E05F 15/60* (2015.01);
(Continued)

(58) Field of Classification Search
CPC ..... E05F 15/73; E05F 15/40; E05F 15/611; E05F 15/43; E05F 15/60; E05F 2900/531; E05F 2015/434
(Continued)

(56) References Cited

U.S. PATENT DOCUMENTS 6,278,376 B1 8/2001 Calamatas
7,761,209 B2 * 7/2010 Morris ..... E05F 5/00 701/49
(Continued)

FOREIGN PATENT DOCUMENTS

KR 1020150042383 A 4/2015

OTHER PUBLICATIONS

International Search Report dated Nov. 28, 2016 for International Application No. PCT/US2016/049858.
(Continued)

*Primary Examiner* — Jerry E Redman
(74) *Attorney, Agent, or Firm* — Veros Legal Solutions LLP

(57) ABSTRACT

A method for opening and closing a door of a vehicle may include receiving a signal indicative of either opening or closing the vehicle door, determining whether the opening or closing will be performed by an operator or via a powered actuator based on the signal, and generating, if the opening or closing will be performed by the powered actuator, a first control signal indicative of a first position to which the door is to be moved. The method may further include controlling
(Continued)

the powered actuator to cause the door to move from an original position to the first position.

17 Claims, 6 Drawing Sheets

Related U.S. Application Data filed on Sep. 24, 2015, provisional application No. 62/214,078, filed on Sep. 3, 2015.

(51) Int. Cl.

| | |
|---|---|
| ***E05F 15/40*** | (2015.01) |
| ***E05F 15/611*** | (2015.01) |
| ***E05F 15/43*** | (2015.01) |
| ***E05F 15/60*** | (2015.01) |
| *E05F 15/657* | (2015.01) |

(52) U.S. Cl.

CPC ..... *E05F 15/611* (2015.01); *E05F 15/657* (2015.01); *E05F 2015/434* (2015.01); *E05Y 2400/53* (2013.01); *E05Y 2400/59* (2013.01); *E05Y 2400/80* (2013.01); *E05Y 2400/81* (2013.01); *E05Y 2400/814* (2013.01); *E05Y 2400/818* (2013.01); *E05Y 2400/85* (2013.01); *E05Y 2800/11* (2013.01); *E05Y 2900/53* (2013.01); *E05Y 2900/531* (2013.01); *E05Y 2900/532* (2013.01); *E05Y 2900/546* (2013.01)

(58) Field of Classification Search

USPC ..... 49/25, 506

See application file for complete search history.

(56) References Cited

U.S. PATENT DOCUMENTS

| | | | | |
|---|---|---|---|---|
| 9,394,737 | B2 * | 7/2016 | Gehin | B60R 25/2054 |
| 9,447,612 | B2 * | 9/2016 | Oakley | E05F 15/70 |
| 9,650,824 | B2 * | 5/2017 | Sauerwein | E05F 5/00 |
| 9,739,082 | B2 * | 8/2017 | Krauss | B60R 25/2054 |
| 9,751,462 | B2 * | 9/2017 | Compton | B60Q 9/00 |
| 9,812,017 | B2 * | 11/2017 | Krauss | B60R 25/2054 |
| 10,151,134 | B2 * | 12/2018 | Dehelean | B60R 25/2054 |
| 10,336,295 | B2 * | 7/2019 | Heller | G07C 9/00309 |
| 10,358,857 | B2 * | 7/2019 | Wheeler | E05F 15/77 |
| 2005/0206182 | A1 | 9/2005 | Depue et al. | |
| 2007/0096905 | A1 | 5/2007 | Ieda et al. | |
| 2008/0296926 | A1 * | 12/2008 | Hanzel | B60R 25/2054 296/146.1 |
| 2009/0033477 | A1 * | 2/2009 | Illium | B60R 21/0134 340/436 |
| 2010/0076651 | A1 * | 3/2010 | Nakakura | E05C 17/00 701/49 |
| 2010/0145617 | A1 * | 6/2010 | Okada | B60R 1/12 701/300 |
| 2010/0228448 | A1 * | 9/2010 | Nakakura | E05F 15/43 701/49 |
| 2011/0313619 | A1 | 12/2011 | Washeleski et al. | |
| 2012/0169355 | A1 | 7/2012 | Cho et al. | |
| 2013/0113614 | A1 * | 5/2013 | Yopp | B60Q 9/00 340/438 |
| 2013/0234844 | A1 * | 9/2013 | Yopp | B60Q 9/008 340/435 |
| 2016/0002959 | A1 * | 1/2016 | Javadzadeh | E05B 77/12 701/46 |
| 2019/0017299 | A1 * | 1/2019 | Capalau | E05B 77/54 |
| 2019/0055770 | A1 * | 2/2019 | Bars | E05F 15/616 |

OTHER PUBLICATIONS

International Search Report dated Jun. 26, 2017 for International Application No. PCT/US2017/020051.

* cited by examiner

SYSTEM AND METHOD FOR OPENING AND CLOSING VEHICLE DOOR

CROSS REFERENCE TO RELATED APPLICATIONS

This application is a National Phase application under 35 U.S.C. § 371 of International Application No. PCT/US2016/049858 filed on Sep. 1, 2016, and claims the benefit of priority based on U.S. Provisional Patent Application No. 62/214,078 filed on Sep. 3, 2015, U.S. Provisional Patent Application No. 62/232,418 filed on Sep. 24, 2015, and U.S. Provisional Patent Application No. 62/235,371 filed on Sep. 30, 2015, the entire disclosures of each of which are incorporated by reference.

TECHNICAL FIELD

The present disclosure generally relates to a system and method for opening and closing a door of a vehicle.

BACKGROUND

A vehicle door is usually equipped with a handle. Such handle is often located below an outer belt line of the door and allows people to manually open the door. For example, an opening handle of the vehicle is for an operator to open the door from the outside of the vehicle. Although this conventional method may be easy to implement, there are some shortcomings. For example, an operator may have to carefully move the door in order to avoid contact between the door and an object in the vicinity of the vehicle (for example, a curb or another vehicle next to the vehicle), which may cause damage to the door and/or the object. In addition, the manual operation of the door may be inconvenient for some people, for example, children, the elderly, and the disabled. Moreover, it may be desired to have a "handle-less" design for aesthetic reasons. Further, the operator, when opening the door, may not anticipate an object moving towards the vehicle (e.g., a cyclist), and the object may collide with the door, which may also damage the object and the door. The present disclosure aims to address at least some of these considerations.

SUMMARY

One aspect of the present disclosure is directed to a system for opening and closing (opening and/or closing also referred to as operating) a door of a vehicle. The system may include an operator interface configured to generate a signal indicative of either opening or closing the door based on an operator's input. The system may also include a sensor configured to detect whether an object is in a projected path of the door as the door moves from an original position to a first position to which the door is to be moved. The system may further include a powered actuator configured to at least one of open and close the door. The system may also include a controller in communication with the operator interface and configured to receive the signal indicative of either opening or closing the vehicle door, and determine whether the opening or closing will be performed by the operator or via the powered actuator based on the signal. The controller is also configured to generate a first control signal indicative of the first position to which the door is to be moved, if the opening or closing will be performed by the powered actuator, and control the powered actuator to cause the door to move to the first position. The controller may be further configured to control the powered actuator, if an object is detected to be within the projected path of the door, to not move the door according to the projected path, and if no object is detected in the projected path, to move the door according to the projected path to the first position.

Another aspect of the present disclosure is directed to a method for opening and closing a door of a vehicle. The method may include receiving, via an operator interface, a signal indicative of either opening or closing the door, and determining, via a controller, whether the opening or closing will be performed by an operator or via a powered actuator based on the signal. The method may also include generating, via the controller, if the opening or closing will be performed by the powered actuator, a first control signal indicative of a first position to which the door is to be moved. The method may further include controlling, based on the first control signal, the powered actuator to cause the door to move from an original position to the first position. The method may further include detecting, via a sensor, whether an object is in a projected path of the door as the door moves from the original position to the first position, and controlling, via the controller, the powered actuator, if the object is detected to be in the projected path of the door, to not move the door according to the projected path, and if no object is detected in the projected path, to move the door according to the projected path to the first position.

Yet another aspect of the present disclosure is directed to a non-transitory computer-readable medium storing instructions that, when executed, cause one or more processors to perform a method for opening and closing a door of a vehicle. The method may include receiving, via an operator interface, a signal indicative of either opening or closing the door, and determining, via a controller, whether the opening or closing will be performed by an operator or via a powered actuator based on the signal. The method may also include generating, via the controller, if the opening or closing will be performed by the powered actuator, a first control signal indicative of a first position to which the door is to be moved. The method may further include controlling, based on the first control signal, the powered actuator to cause the door to move from an original position to the first position. The method may further include detecting, via a sensor, whether an object is in a projected path of the door as the door moves from the original position to the first position, and controlling, via the controller, the powered actuator, if the object is detected to be in the projected path of the door, to not move the door according to the projected path, and if no object is detected in the projected path, to move the door according to the projected path to the first position.

DETAILED DESCRIPTION

The disclosure is directed to a system and method for opening and closing a vehicle door. It is contemplated that the vehicle may be an electric vehicle, a fuel cell vehicle, a hybrid vehicle, a conventional internal combustion engine vehicle, or combinations thereof. The vehicle may have any body style, such as a sports car, a coupe, a sedan, a pickup truck, a station wagon, a sports utility vehicle (SUV), a minivan, or a conversion van. The vehicle may be configured to be operated by an operator, occupying the vehicle, remotely controlled, and/or autonomous.

In some embodiments, the system may be configured to open or close a door of the vehicle in different modes based on an operator's input. For example, the system may operate in a powered mode, in which at least a part of the opening or closing is performed by one or more powered actuators controlled by a controller. The system may also include a sensor to detect an object that is within a vicinity of a portion of a door. The system may further include a protecting mechanism configured to prevent the door from coming into contact with such object.

In some embodiments, the system determines whether the opening or closing of the door is to be performed in a manual or powered mode based on a signal received from an operator interface. In the manual mode, at least a part of the opening or closing is performed by an operator (e.g., a driver, a passenger, or an authorized person who can access the vehicle or operate the vehicle door). On the other hand, in the powered mode, the opening or closing is performed by one or more actuators coupled to a controller, which is configured to control the operations of the one or more actuators.

In some embodiments, the system may detect one or more objects within the vicinity of the vehicle and determine whether detected objects are (or will be likely to be) within in a projected path of a door of the vehicle as the door moves from its closed position to an open position.

Figure 1:
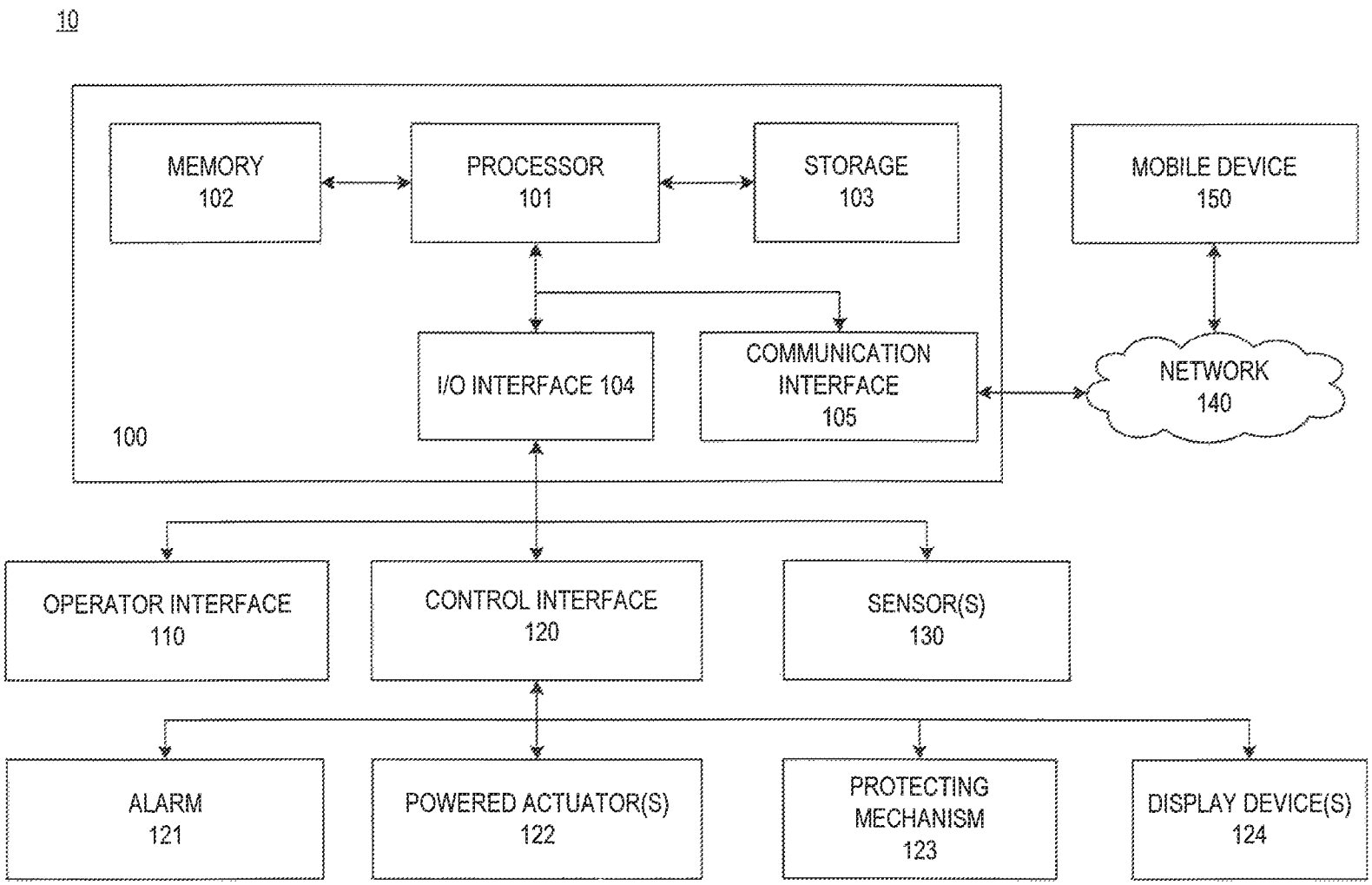
FIG. 1 is a block diagram of an exemplary embodiment of a system for opening and closing a vehicle door.

FIG. 1 is a block diagram of an exemplary system 10 for opening or closing a door of a vehicle. As illustrated in FIG. 1, system 10 may include a controller 100, an operator interface 110, a control interface 120, and one or more sensors 130. System 10 may also include an alarm 121 configured to generate an audio, visual, or display alert under certain circumstances. System 10 may further include one or more powered actuators 122 configured to open or close the doors of the vehicle. System 10 may also include a protecting mechanism 123 configured to resist movement of the doors under certain circumstances. System 10 may also include one or more display devices 124 configured to display data captured by sensor 130.

Controller 100 may have, among other things, a processor 101, a memory 102, storage 103, an I/O interface 104, and/or a communication interface 105. At least some of these components of controller 100 may be configured to transfer data and send or receive instructions between or among each other.

Processor 101 may be configured to receive signals from components of system 10 and process the signals to determine one or more conditions of the operations of system 10. Processor 101 may also be configured to generate and transmit a control signal via, for example, I/O interface 104, in order to actuate one or more components of system 10. For example, processor 101 may receive a signal indicative of opening or closing a door of the vehicle from operator interface 110, in response to an operator's input. Processor 101 may also instruct one or more powered actuator 122 to open or close the door based on the signal received.

In operation, according to some embodiments, processor 101 may execute computer instructions (program codes) stored in memory 102 and/or storage 103, and perform exemplary functions in accordance with exemplary techniques described in this disclosure. Processor 101 may include or be part of one or more processing devices, such as, for example, a microprocessor. Processor 101 may include any type of a single or multi-core processor, a mobile device, a microcontroller, a central processing unit, etc.

Memory 102 and/or storage 103 may include any appropriate type of storage provided to store any type of information that processor 101 may need to operate. Memory 102 and storage 103 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Storage 103 may include one or more hard disk devices, optical disk devices, or other storage devices to provide storage space. Memory 102 and/or storage 103 may also be viewed as what is more generally referred to as a "computer program product" having executable computer instructions (program codes) as described herein. Memory 102 and/or storage 103 may be configured to store one or more computer programs that may be executed by processor 101 to perform exemplary functions disclosed in this application. Memory 102 and/or storage 103 may be further configured to store data used by processor 101. For instance, memory 102 and/or storage 103 may be configured to store parameters for controlling one or more of powered actuators 122, including, for example, distances that a door may travel during closing or opening. Memory 102 and/or storage 103 may also be configured to store thresholds used by processor 101 in determining processes as described herein. For example, memory 102 and/or storage 103 may store a threshold distance used by processor 101 to determine whether an object is too close to the door, as explained herein.

I/O interface 104 may be configured to facilitate communication between controller 100 and other component(s) of system 10. For example, as illustrated in FIG. 1, I/O interface 104 may receive from operator interface 110 a signal indicative of either opening or closing the vehicle door, and send the signal to processor 101 for further processing. For example, the signal may include one or more signals initiated by an occupant of the vehicle desiring to open the door via a switch or touch pad. I/O interface 104 may also receive signals from one or more of sensors 130 for detecting whether an object is within a projected path of the door as the door moves from a closed position to an open position. According to some embodiments, detecting whether an object is within a projected path of the door includes detecting whether the object is moving, and if so, measuring the direction of the travel and/or speed of the moving object and determining whether the moving object will be within the projected path of the door based on the direction of travel and/or speed. I/O interface 104 may also send the signals to processor 101 for further processing. I/O interface 104 may also receive one or more control signals from processor 101, and send the signals to control interface 120, which may be configured to control the operations of one or more of powered actuators 122 (e.g., linear actuators and/or motors), protecting mechanism 123, display device 124, and/or alarm 121. More exemplary functions of the components of system 10 are described below in connection with FIGS. 2-6.

Communication interface 105 may be configured to transmit and receive data with, among other devices, one or more mobile devices 150 over a network 140. For example, communication interface 105 may be configured to receive from mobile device 150 a signal indicative of opening a door. Communication interface 105 may also transmit the signal to processor 101 for further processing.

Figure 2:
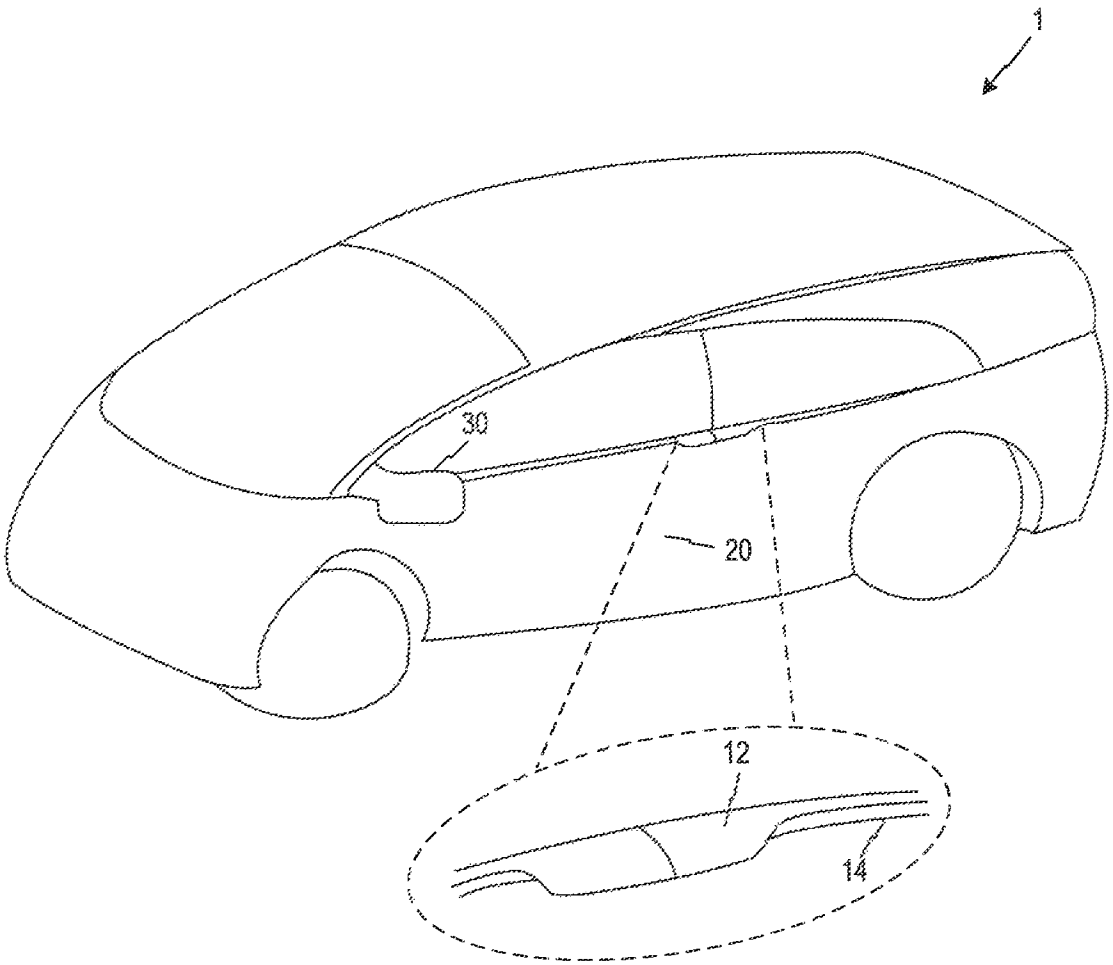
FIG. 2 is an exemplary embodiment of a vehicle configured to implement the exemplary system of FIG. 1.

Operator interface 110 may be located on the exterior of the door or vehicle. FIG. 2 is an exemplary embodiment of a vehicle 1 configured to implement system 10, Vehicle 1 may include input 12 and/or outer belt 14. Operator interface 110 may be part of or located on input 12, outer belt 14, and/or one or more other components on the exterior of vehicle 1, such as, an A-pillar, a B-pillar, a C-pillar, and/or a tailgate. Additionally or alternatively, operator interface 110 may be located on the interior side of the door and/or other component(s) inside the vehicle. For example, operator interface 110 may be part of or located on the steering wheel, the control console, and/or the interior side of the door (not shown). In some embodiments, operator interface 110 may be located on or within parts connecting the door and the locking mechanism of the vehicle.

Operator interface 110 may be configured to generate a signal for opening or closing the door in response to an action by an operator (e.g., a driver, a passenger, or an authorized person who can access the vehicle or open or close the vehicle door). Operator interface 110 may sense a force pushing the door exerted by the operator inside or outside the vehicle, and generate a signal based on the force. For example, operator interface 110 may be a pull handle, a button, a touch pad, a key pad, an imaging sensor, a sound sensor (e.g., microphone), a force sensor, a motion sensor, or a finger/palm scanner, or the like, or a combination thereof. Operator interface 110 may be configured to receive an input from the operator. Exemplary input may include a touch input, gesture input (e.g., hand waving, etc.), a key stroke, force, sound, speech, face recognition, finger print, hand print, or the like, or a combination thereof. Operator interface 110 may also generate a signal based on the received input and transmit the signal to controller 100, via, for example, I/O interface 104, for further processing.

Control interface 120 may be configured to receive a control signal from controller 100 for controlling, among other devices, alarm 121, powered actuator(s) 122, protecting mechanism 123, and/or display device(s) 124. Control interface 120 may also be configured to control alarm 121, powered actuator(s) 122, protecting mechanism 123, and/or display device(s) 124 based on the control signal.

One or more display devices 124 are configured to display data captured by sensor 130 (e.g., images and/or videos captured by one or more cameras, i.e., part of sensor 130). Display device 124 may be located on the interior side of the door and/or other component(s) inside the vehicle. For example, display device 124 may be part of, or located on, the dash board, the control console, and/or the interior side of the door (not shown).

One or more alarms 121 are configured to warn the operator when an object is detected to be close to the door (or the vehicle). For example, when an object is detected to be within a projected path of a side door moving from its closed position to an open position, alarm 121 may output a sound warning, and display device 124 may display the image and/or video showing the object, which may be captured by the camera in real-time.

One or more sensors 130 may be configured to detect any object, stationary or moving, within a vicinity of the vehicle. Sensor 130 may be located on the exterior of the door or vehicle, the interior side of the door, or inside the vehicle. For example, sensor 130 may be located on a door 20 in FIG. 2 (e.g., near the bottom of the door) and/or one or more side mirrors 30 in FIG. 2. In some embodiments, sensor 130 may be also located on a door such as a tailgate (not shown), and configured to detect object(s) behind (e.g., a car, a pedestrian, or a garage door behind the vehicle) or above the vehicle (e.g., a garage ceiling).

Sensor 130 may be configured to detect any object moving towards the vehicle, for example, a cyclist, an automobile, a pedestrian, etc. Sensor 130 may also be configured to measure in real time distances between the objects outside the vehicle and at least a portion of the door, and transmit such information to controller 100. In some embodiments, sensor 130 may be a sensor configured to emit light for irradiating the surface of the surrounding object(s) and measure the distance of such object(s) from the door based on the reflected light received. In some embodiments, sensor 130 may be an imaging sensor configured to measure the distance(s) based on the image(s) of the objects captured. In some embodiments, sensor 130 may be an ultrasonic sensor configured to emit ultrasonic signals and detect object(s) based on the reflected ultrasonic signals. Other types of sensors are contemplated.

According to some embodiments, mobile device 150 may be configured to generate a signal indicative of opening or closing a door in response to the operator's input. Mobile device 150 may transmit the signal to system 10 over network 140. Network 140 may be any type of wired or wireless network for transmitting and receiving data. For example, network 140 may be wired, a local wireless network, (e.g., Bluetooth™, WiFi, near field communications (NFC), etc.), a cellular network, or the like, or a combination thereof. Other network types are contemplated.

Mobile device 150 may be any type of a general purpose computing device. For example, mobile device 150 may include a smart phone with computing capacity, a tablet, a personal computer, a wearable device (e.g., Google Glass™ or smart watches, and/or affiliated components), or the like, or a combination thereof. In some embodiments, a plurality of mobile devices 150 may be associated with selected persons. For example, mobile devices 150 may be associated with the owner(s) of the vehicle, and/or one or more authorized people (e.g., friends or family members of the owner(s) of the vehicle). More exemplary functions of mobile device 150 are discussed below in connection with FIGS. 3-6.

Figure 3:
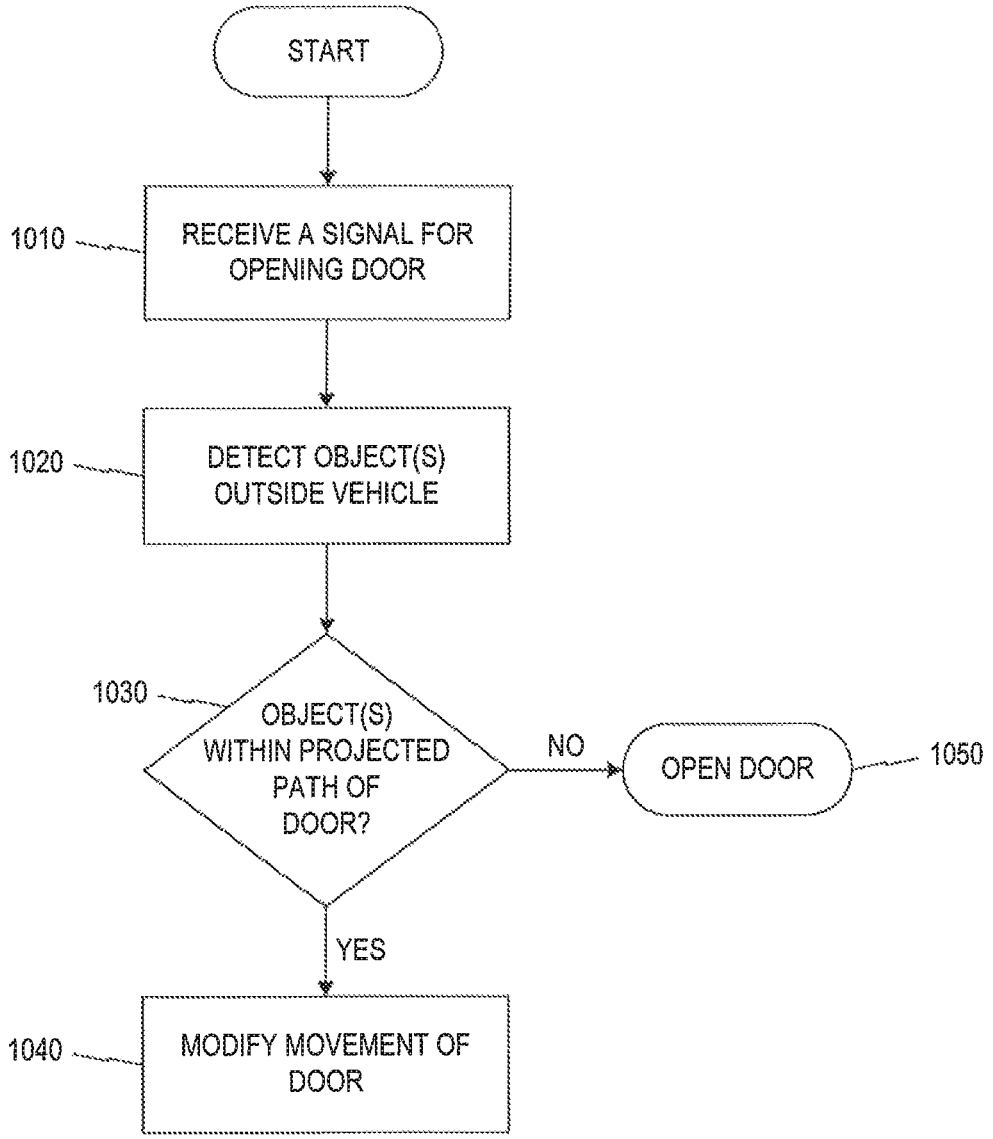
FIG. 3 is a flow chart of a first exemplary embodiment of a process that may be performed by the system of FIG. 1.

FIG. 3 is a first exemplary flow chart of process 1000 for opening a vehicle door. At 1010, processor 101 may receive via, for example, I/O interface 104, a signal for opening the vehicle door from, for example, operator interface 110. For example, the operator may indicate to operator interface 110 whether opening is intended.

Additionally or alternatively, controller 100 may receive a signal from mobile device 150 via communication interface 105 for opening the door. For example, the operator may interact with mobile device 150, which may then generate a signal and transmit the signal to controller 100 via network 140.

The signal generated by operator interface 110 and/or communication interface 105 may include information relating to whether the opening of the door is in the manual mode (i.e., at least a part of the opening is performed by the operator or someone else) or powered mode (i.e., the opening is performed by one or more of actuators 122, which may be controlled by, for example, controller 100 via, for example, control interface 120).

At 1020, sensor 130 may detect one or more objects outside the vehicle. For example, sensor 130 may include a sensor configured to emit light for irradiating the surface of the surrounding object(s) and detect such object(s) based on the reflected light received. In some embodiments, sensor 130 may include an ultrasonic sensor configured to emit ultrasonic signals and detect object(s) based on the reflected ultrasonic signals. In some embodiments, sensor 130 may include an imaging sensor (e.g., a video camera) configured to detect surrounding subjects. In some embodiments, sensor 130 may include a radar sensor. In some embodiments, sensor 130 may include a capability of image processing from cameras in one or more mirrors. Other types of sensors are contemplated.

Further at 1020, when one or more objects are detected, controller 100 may also instruct display device 124 to display an image and/or video showing the detected objects captured by sensor 130 (e.g., a video camera located on a side mirror 30 in FIG. 2) so that the operator may be notified of the positions of the objects. Additionally or alternatively, controller 100 may display a message and/or actuate an alarm via I/O interface 104 or alarm 121.

At 1030, controller 100 and/or sensor 130 may determine whether the detected object is (or will be likely to be) within a projected path of the door as the door moves from its original position to an open position. The projected path can be determined based, for example, on the dimension of the door and the maximum door opening angle. If the detected object is not (and/or will be unlikely to be) within a projected path of the door as the door moves from its closed position to an open position, system 10 may activate one or more of actuators 122 to move the door from the closed position to the open position (at 1050). On the other hand, if the detected object is (and/or is likely to be) within a projected path of the door as the door moves from its closed position to an open position, system 10 may modify the movement of the door. For example, controller 100 may instruct control interface 120 to control one or more of actuators 122 (at 1040) to stop moving the door. In some embodiments, controller 100 may instruct a blocking mechanism (not shown) to stop moving the door. In some embodiments, controller 100 may also instruct control interface 120 to control one or more actuators of 122 to move the door back (or towards) its closed position (i.e., closing the door). In some embodiments, the door is not moved at all. In some embodiments, controller 100 may also actuate an alarm, via I/O interface 104 and/or alarm 121. Additionally, or alternatively, controller 100 may also instruct display device 124 to display an image and/or video showing the detected object, as described herein. In some embodiments, controller 100 may further notify the operator that the door may not be moved because one or more objects are within the projected path of the door, and wait for further instructions from the operator. The notification may be provided by, for example, displaying a message on display device 124, actuating an alarm via I/O interface 104 and/or alarm 121. The operator may then manually pull the door to a desired position, in order to avoid the contact of the door with the object(s).

Figure 4:
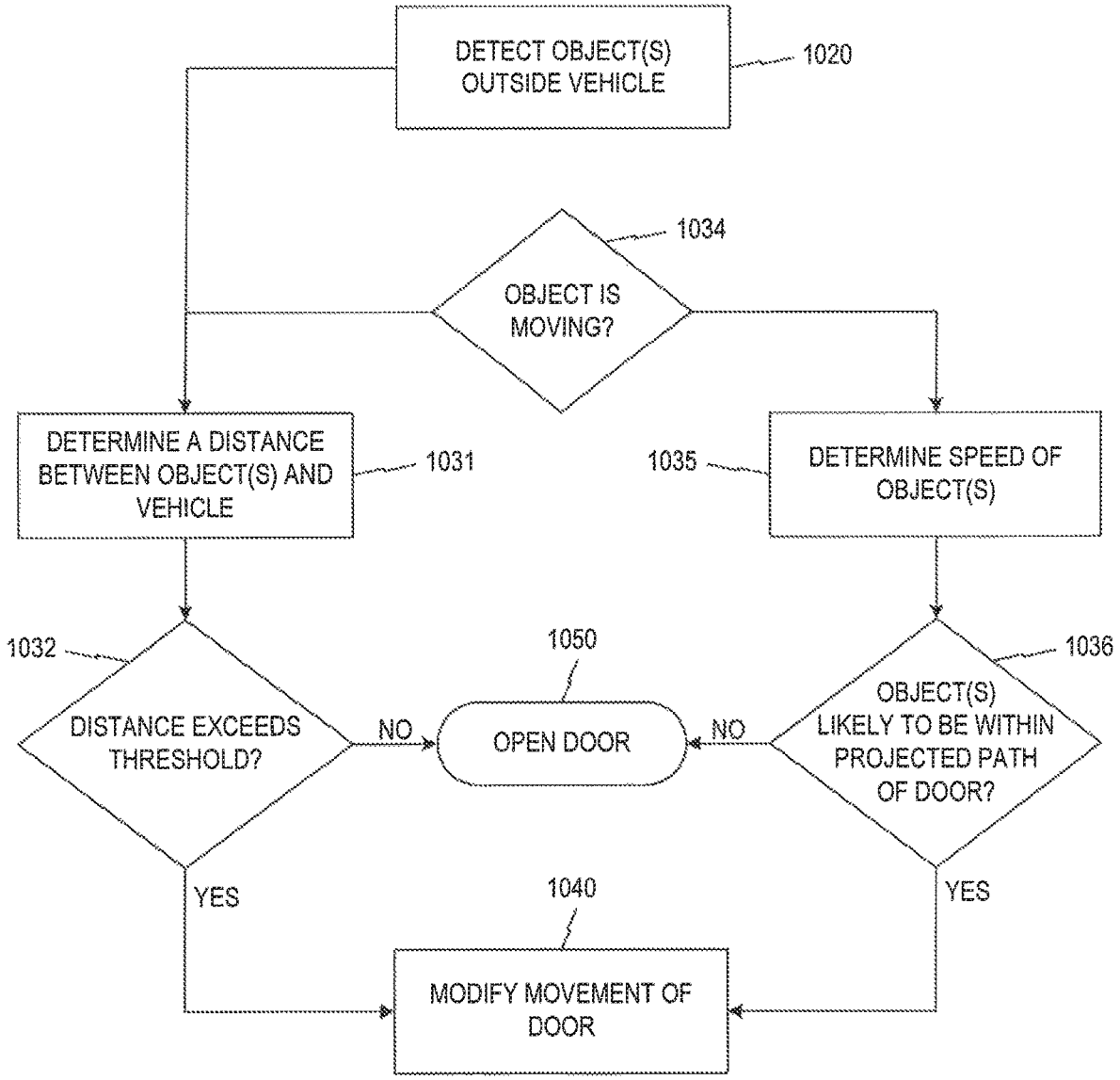
FIG. 4 is a flow chart of a second exemplary embodiment of a process that may be performed by the system of FIG. 1.

In some embodiments, step 1030 may be performed according to a second exemplary process illustrated in FIG. 4. At 1031, when one or more objects are detected, sensor 130 may measure a distance between the object and the door (and/or the vehicle). Merely by way of example, the distances between several points on an object and several points on the exterior of the vehicle door and/or vehicle may be determined. The determined distances may be compared, and the smallest distance may be used in further processes including, for example, determining whether the distance is equal to or smaller than a threshold distance, as explained in more detail herein. In some embodiments, sensor 130 may measure the distance based on the reflected signal (radar, light, and/or ultrasonic signal) received and/or an image captured by sensor 130.

At 1032, sensor 130 and/or controller 100 may determine whether the distance(s) is/are equal to or smaller than a threshold distance. If the distance(s) is/are equal to or smaller than the threshold distance, at 1040, system 10 may modify the movement of the door, as described herein. On the other hand, if the distance(s) is/are larger than the threshold distance, system 10 may not modify the movement of the door and initiate opening of the door (at 1050), as described herein.

Additionally and/or alternatively, when one or more objects are detected, at 1034, sensor 130 and/or controller 100 may determine whether the detected object is moving. If the object is not moving, sensor 130 may measure a distance between the object and the door (and/or the vehicle) (at 1031), and sensor 130 and/or controller 100 may determine whether the distance(s) is/are equal to or smaller than a threshold distance (at 1032), as described herein. On the other hand, if the object is moving, sensor 130 and/or controller 100 may determine a moving direction of the object (e.g., moving towards or away from the vehicle) and/or a speed at which the object is moving. Sensor 130 and/or controller 100 may further determine a distance between the object and the door (and/or the vehicle), and/or determine whether the distance(s) is/are equal to or smaller than a threshold distance, as described herein.

At 1036, sensor 130 and/or controller 100 may determine whether the object will be likely to be within a projected path of the door as the door moves from a closed position to an open position based, at least in part, on the distance between the object and the door (and/or the vehicle), the moving direction of the object, and/or the speed at which the object is moving. If it is determined that the object is unlikely to be within the projected path of the door, system 10 may not modify the movement of the door (at 1050) and initiate opening of the door. On the other hand, if the object is likely to be within the projected path, system 10 may modify the movement of the door (at 1040) as described herein to avoid contact with the object.

Figure 5:
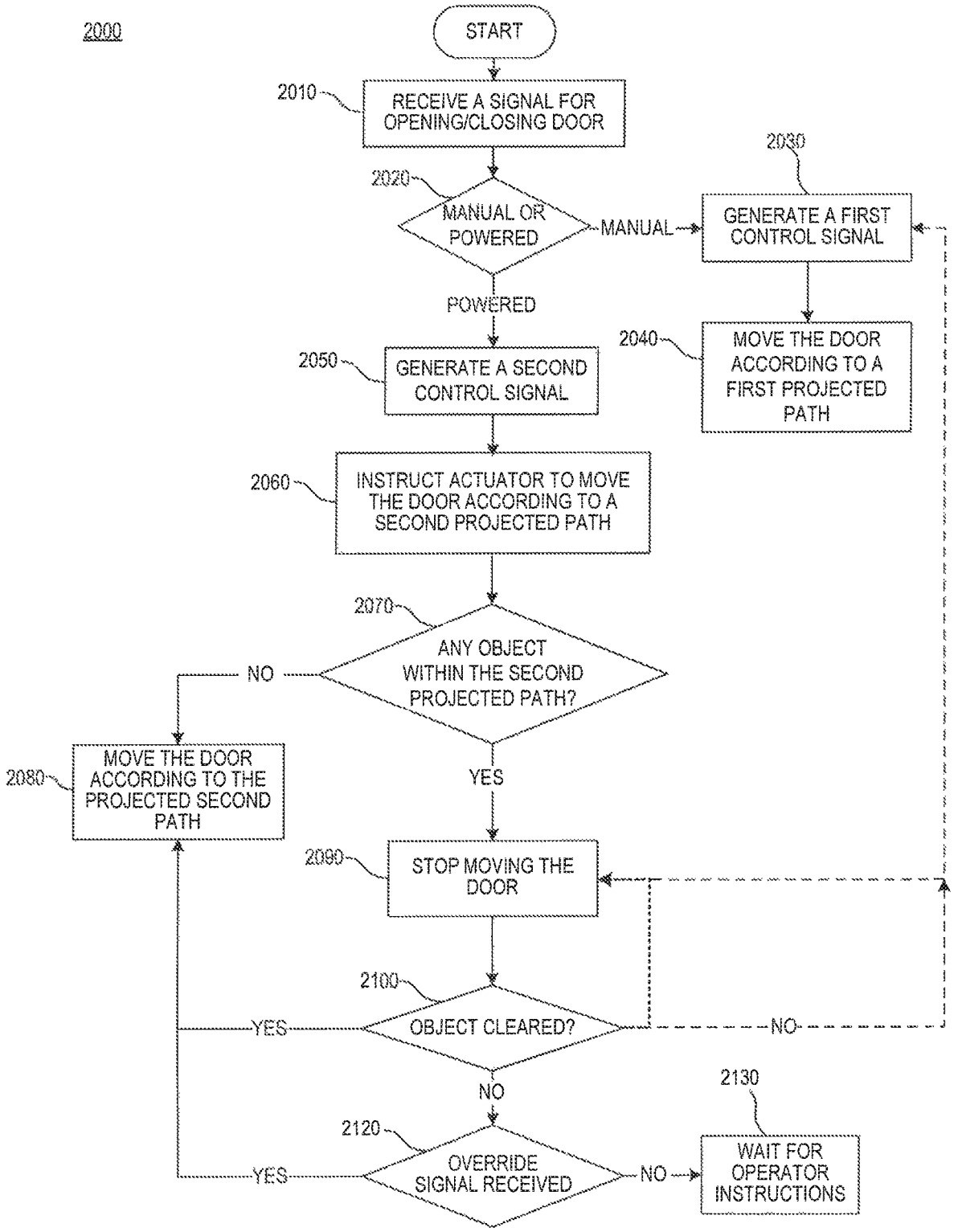
FIG. 5 is a flow chart of a third exemplary embodiment of a process that may be performed by the system of FIG. 1.

FIG. 5 is a third exemplary flow chart of process 2000 for opening/closing a door of a vehicle. At 2010, processor 101 may receive via, for example, I/O interface 104, a signal for opening or closing the vehicle door from, for example, operator interface 110.

At 2020, controller 100 may determine whether the door is to be opened or closed and whether the moving of the door is performed in the manual mode or powered mode, based on the signal transmitted from operator interface 110. If the moving is in the manual mode, controller 100 may, at 2030, be configured to generate a first control signal and transmit it to control interface 120 for controlling one or more of actuators 122. For example, if controller 100 determines that opening the door from the closed position is requested and the opening is in the manual mode, controller 100 may generate a control signal and transmit it to control interface 120. The control signal may be used to instruct control interface 120 to control one or more actuators 122 to "pop" the door from the closed or locked position (e.g., releasing the door from the closed position and moving the door by a small distance along a first projected path), and one or more of actuators 122 may perform accordingly, such that the operator may manually move the door to a desired position.

If controller 100 determines that moving/operating the door (either opening or closing the door) is in the powered mode, controller 100 may generate a second control (at 2050) signal indicative of a destination position to which the door is to be moved and transmit the signal to control interface 120 for controlling one or more of actuators 122 to cause the door move to that position along a second projected path (at 2060). The destination position to which the door is to be moved may be pre-determined. For example, if the door is open and the operator indicates that the door is to be closed, the destination position may be the closed position of the door (e.g., the door is completely closed). If the door is at its closed position, the destination position of the door may be one that allows the operator (or another person) to enter or exit the vehicle. The destination position may be adjustable based on different conditions. In some embodiments, controller 100 may determine the destination position based on the surroundings of the vehicle. For example, sensor 130, which may be located at the exterior of the door or the vehicle, may be configured to detect distances between the objects outside the vehicle and at least a portion of the door, and transmit such information to controller 100. Controller 100 may then determine, based on the information received, a proper destination position to which the door may be moved, in order to avoid contact between the door and the object. Merely by way of example, the distances between an object and several points on the exterior of the vehicle door are determined. The determined distances may be compared, and the smallest distance may be used in further processes including, for example, determining whether the distance is equal to or smaller than a threshold distance, as explained in more detail herein. Additionally or alternatively, controller 100 may choose the destination position from a plurality of predefined possible positions.

At 2070, sensor 130 may determine in real time whether any object is within the second projected path of the vehicle door as the door moves from an original position to a destination position. In some embodiments, sensor 130 may be configured to determine the distances between an object outside of the vehicle and at least a portion of the vehicle door. Additionally or alternatively, controller 100 may determine whether any object is within the projected path of the door based on the information (e.g., distance information of the objects) transmitted from sensor 130.

If it is determined that no object is within the second projected path, at 2080, controller 100 may instruct control interface 120 to control one or more actuators 122 to move the door to the destination position. On the other hand, if it is determined that at least one object is within the second projected path, at 2090, controller 100 may instruct control interface 120 to control one or more actuators 122 to stop moving the door. Alternatively, controller 100 may instruct a blocking mechanism (not shown) to stop moving the door. In some embodiments, the door is not moved at all. In some embodiments, the door is moved but stopped before it reaches the destination position when it is detected that an object is within the second projected path. Controller 100 may also actuate an alarm if it is determined that at least one object is within the projected path.

In some embodiments, if it is determined that at least one object is within the projected path, controller 100 may switch the door moving to the manual mode and generate a different control signal (2030), such that the operator may move the door manually to a desired position (2040). Alternatively, controller 100 may generate a different control signal indicative of a modified destination position based on information transmitted by sensor 130, and one or more actuators 122 may move the door to the modified destination position along, for example, a modified projected path accordingly. Sensor 130 may continue to detect whether any object is within the modified projected path (back to 2070), and controller 100 may further modify the destination position based on the updated information from sensor 130.

In some embodiments, sensor 130 may determine the distance(s) between one or more objects and at least a portion of the door. Sensor 130 and/or controller 100 may further determine whether the distance(s) is/are equal to or smaller than a threshold distance. If it is determined that the distance(s) is/are equal to or smaller the threshold distance, controller 100 may instruct control interface 120 to control one or more actuators of 122 to stop moving the door.

Sensor 130 or controller 100 may further determine, at 2100, whether the object(s) has/have been cleared from the projected path of the door. If it is determined that the object(s) has/have been cleared from the projected path, controller 100 may instruct control interface 120 to control one or more of actuators 122 to move the door to, for example, the original destination position (2080). On the other hand, if it is determined that the object(s) remains/remain within the projected path (or a new object is detected within the projected path), controller 100 may instruct control interface 120 to control one or more of actuators 122 to stop moving the door (2090). Alternatively, controller 100 may perform steps 2030 and 2040 as explained herein.

In some embodiments, if it is determined that the object(s) remains/remain within the projected path (or new object(s) is/are detected within the projected path), controller 100 may generate an overriding signal (at 2120) and transmit the signal to control interface 120 to control one or more actuators 122 to move the door to the original destination position (2080) according to, for example, the projected path. Alternatively, controller 100 may notify the operator that the door may not be moved because one or more objects are within the projected path of the door to the destination position, and wait for further instructions from the operator (2130). The notification may be provided by, for example, displaying a message and/or actuating an alarm via I/O interface 104. The operator may then manually push (or pull) the door to a desired position, in order to avoid the contact of the door with the object(s).

Figure 6:
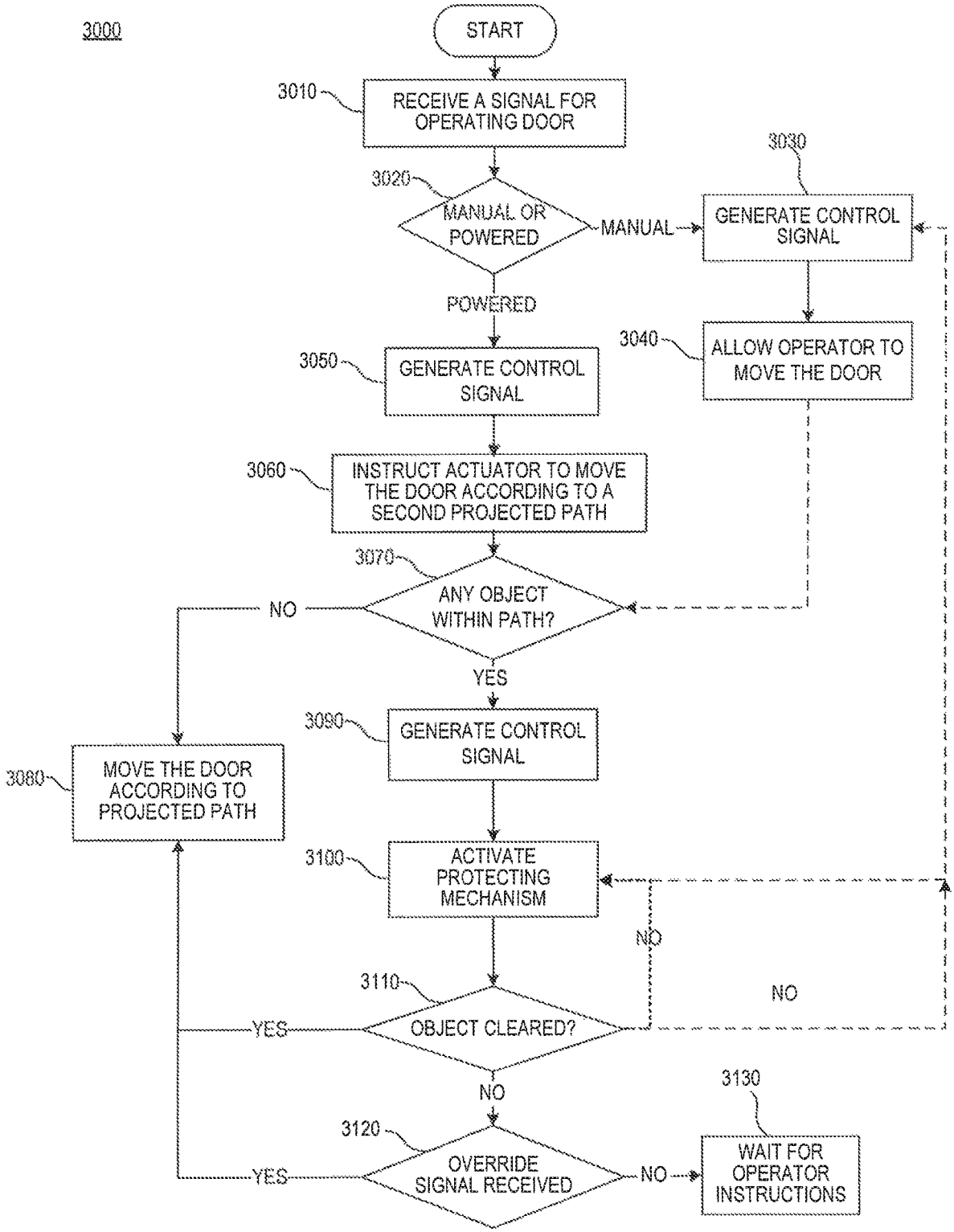
FIG. 6 is a flow chart of a fourth exemplary embodiment of a process that may be performed by the system of FIG. 1.

Referring to FIG. 6, FIG. 6 is a fourth exemplary flow chart of process 3000 for opening and closing a door of a vehicle. Compared with the third exemplary flow chart of process 2000 in FIG. 5, a primary feature of process 3000 is to activate protecting mechanism 123. Namely, if it is determined that at least one object is within the projected path, controller 100 may generate a control signal (at 3090) for activating protecting mechanism 123. At 3100, control interface 120 may activate protecting mechanism 123 based on the control signal transmitted from controller 100. In some embodiments, protecting mechanism 123 may be configured to provide electromagnetic force resisting movement of the door. Other steps of process 3000 are the same or similar to the corresponding steps of process 2000, therefore, are not described again herein.

According to some embodiments, the manual mode may be assisted by one or more of powered actuators 122. Powered actuator 122 may be one of a linear actuator or a motor configured to cause a door to move to a destination position determined by controller 100. For example, powered actuators 122 may be electrically, hydraulically, and/or pneumatically powered.

In some embodiments, the door is moved but stopped before it reaches the destination position when it is detected that an object is within the projected path. Controller 100 may also actuate alarm 121 to provide a visual or sound alert if it is determined that at least one object is within the projected path.

In some embodiments, if the operation of the door is in the manual mode, controller 100 may prevent the operator from moving the door to a full-swing position, in order to avoid contact between the door and a surrounding object. For example, controller 100 may determine whether there is any object within a projected path from the door's original position to the full-swing position. If so, controller 100 may determine a second position to which the door can be manually moved such that the door will not be in contact with the object. For example, sensor 130 may measure a distance of an object from a portion of the door, and controller 100 may determine a second position to which the door can be manually moved such that the distance is larger than a threshold distance and the door will not come into contact with the object.

Additionally or alternatively, protecting mechanism 123 may be configured to stop the manual movement of the door if an object is getting too close to the door. For example, sensor 130 may measure in real time a distance of an object from a portion of the door as the operator moves the door manually. Controller 100 and/or sensor 130 may determine whether the distance is equal to or smaller than a threshold distance. If so, controller 100 may instruct protecting mechanism 123 to prevent the door from moving.

In some embodiments, in addition to stopping the door under certain circumstances (e.g., detecting an object in the projected path of the door), the door may be slowed in the powered mode and/or in the manual mode (e.g., progressively slowed until a threshold distance is reached, at which point the door is stopped completely).

It will be apparent to those skilled in the art that various modifications and variations can be made to the disclosed systems and methods. Other embodiments will be apparent to those skilled in the art from consideration of the specification and practice of the systems and methods. It is intended that the specification and examples be considered as exemplary only, with a true scope being indicated by the following claims and their equivalents.

What is claimed is:

1. A method for opening and closing a door of a vehicle, the method comprising:

generating a signal indicative of either opening or closing the door based on a force exerted on the door by an operator;

receiving, via an operator interface, the signal indicative of either opening or closing the door;

determining, via a controller, whether the opening or closing will be performed by an operator or via a powered actuator based on the signal;

generating, via the controller, if the opening or closing will be performed by the powered actuator, a first control signal indicative of a first position to which the door is to be moved;

controlling, based on the first control signal, the powered actuator to cause the door to move from an original position to the first position;

detecting, via a sensor, whether an object is in a projected path of the door as the door moves from the original position to the first position; and controlling, via the controller, the powered actuator, if the object is detected to be in the projected path of the door, to not move the door according to the projected path, and if no object is detected in the projected path, to move the door according to the projected path to the first position;

generating, via the controller, if the opening or closing will be performed by the operator, a second control signal indicative of a second position to which the door will be moved;

controlling, via the controller, based on the second control signal, the powered actuator to cause the door to move from the original position to the second position; and allowing the operator to move the door manually to a desired position.

2. The method of claim 1, further comprising:

detecting, via the sensor, whether the object has been removed from the projected path; and controlling, via the controller, the powered actuator to cause the door to move according to the projected path.

3. The method of claim 1, further comprising actuating, via the controller, an alarm when the object is detected to be in the projected path.

4. The method of claim 1, further comprising:

receiving, from the operator interface, an override signal if the door is not moved according to the projected path; and controlling, via the controller, the powered actuator to cause the door to move according to the projected path to the first position.

5. The method of claim 1, further comprising:

measuring, via the sensor, a distance of the object from a portion of the door;

determining, via the controller, whether the distance is equal to or smaller than a threshold distance; and stopping the door from moving if the distance is equal to or smaller than the threshold distance.

6. The method of claim 1, further comprising:

generating, via the controller, a third control signal for activating a protecting mechanism if the object is detected to be in the projected path; and controlling, based on the third control signal, the protecting mechanism such that the powered actuator does not move the door according to the projected path.

7. A system for opening and closing a door of a vehicle, the system comprising:

an operator interface configured to generate, based on an operator's force exerted on the door, a signal indicative of either opening or closing the door;

a sensor configured to detect whether an object is in a projected path of the door as the door moves from an original position to a first position to which the door is to be moved;

a powered actuator configured to at least one of open and close the door;

a controller in communication with the operator interface and configured to:

receive the signal indicative of either opening or closing the door, determine whether the opening or closing will be performed by the operator or via the powered actuator based on the signal, generate, if the opening or closing will be performed by the powered actuator, a first control signal indicative of a first position to which the door is to be moved, and control the powered actuator to cause the door to move from the original position to the first position, wherein the controller is further configured to control the powered actuator, if the object is detected to be in the projected path of the door, to not move the door according to the projected path, and if no object is detected in the projected path, to move the door according to the projected path to the first position;

and wherein the controller is further configured to:

generate, if the opening or closing will be performed by the operator, a second control signal indicative of a second position to which the door will be moved;

control, based on the second control signal, the powered actuator such that the door is moved from the original position to the second position; and allow the operator to move the door manually to a desired position.

8. The system of claim 7, wherein the sensor is further configured to detect whether the object has been removed from the projected path, and the controller is further configured to control the powered actuator to move the door according to the projected path.

9. The system of claim 7, wherein the controller is further configured to actuate an alarm when the object is detected to be in the projected path.

10. The system of claim 7, wherein the controller is further configured to:

receive, from the operator interface, an override signal if the door is not moved according to the projected path; and control the powered actuator such that the door moves according to the projected path to the first position.

11. The system of claim 7, wherein:

the sensor is further configured to generate a signal indicative of a distance of the object from a portion of the door; and the controller is further configured to:

determine, based on the signal indicative of the distance, whether the distance is equal to or smaller than a threshold distance, and stop the door from moving if the distance is equal to or smaller than the threshold distance.

12. The system of claim 7, further comprising a protecting mechanism wherein the controller is further configured to:

generate a third control signal for activating the protecting mechanism if the object is detected to be in the projected path; and control, based on the third control signal, the protecting mechanism such that the powered actuator does not move the door according to the projected path.

13. A non-transitory computer-readable medium storing instructions that, when executed, cause one or more processors to perform a method for opening and closing a door of a vehicle, the method comprising:

generating a signal indicative of either opening or closing the door based on a force exerted on the door by an operator;

receiving, via an operator interface, the signal indicative of either opening or closing the door;

determining, via a controller, whether the opening or closing will be performed by the operator or via a powered actuator based on the signal;

generating, via the controller, if the opening or closing will be performed by the powered actuator, a first control signal indicative of a first position to which the door is to be moved;

controlling, based on the first control signal, the powered actuator to cause the door to move from an original position to the first position;

detecting, via a sensor, whether an object is in a projected path of the door as the door moves from the original position to the first position;

controlling, via the controller, the powered actuator, if the object is detected to be in the projected path of the door, to not move the door according to the projected path, and if no object is detected in the projected path, to move the door according to the projected path to the first position;

generating, via the controller, if the opening or closing will be performed by the operator, a second control signal indicative of a second position to which the door will be moved;

controlling, via the controller, based on the second control signal, the powered actuator to cause the door to move from the original position to the second position; and allowing the operator to move the door manually to a desired position.

14. The non-transitory computer-readable medium of claim 13, the method further comprising:

detecting, via the sensor, whether the object has been removed from the projected path; and controlling, via the controller, the powered actuator to cause the door to move according to the projected path.

15. The non-transitory computer-readable medium of claim 13, the method further comprising actuating, via the controller, an alarm when the object is detected to be in the projected path.

16. The non-transitory computer-readable medium of claim 13, the method further comprising:

receiving, from the operator interface, an override signal if the door is not moved according to the projected path; and controlling, via the controller, the powered actuator to cause the door to move according to the projected path to the first position.

17. The non-transitory computer-readable medium of claim 13, the method further comprising:

measuring, via the sensor, a distance of the object from a portion of the door;

determining, via the controller, whether the distance is equal to or smaller than a threshold distance; and stopping the door from moving if the distance is equal to or smaller than the threshold distance.

* * * * *